United States Patent [19]

Oyama

[11] Patent Number: 4,542,366

[45] Date of Patent: Sep. 17, 1985

[54] ILLUMINATED VARIABLE RESISTOR

[75] Inventor: Akira Oyama, Miyagi, Japan

[73] Assignee: Alps Electric Co., Ltd., Japan

[21] Appl. No.: 505,198

[22] Filed: Jun. 17, 1983

[30] Foreign Application Priority Data

Jun. 18, 1982 [JP] Japan ..... 57-90190[U]

[51] Int. Cl.[4] ..... H01C 10/00

[52] U.S. Cl. ..... 338/196; 338/119; 338/134; 338/163; 338/184

[58] Field of Search ..... 338/119, 196, 134, 163, 338/184, 199

[56] References Cited

U.S. PATENT DOCUMENTS 3,848,219 11/1974 Oka ..... 338/119

*Primary Examiner*—C. L. Albritton

*Attorney, Agent, or Firm*—Guy W. Shoup; Gerard F. Dunne

[57] ABSTRACT

A rotary type illuminated variable resistor wherein a light source is disposed in a case, and first and second optical guide members for guiding light from the light source are respectively disposed in a hollow shaft and a hollow knob. When the knob is rotated, the second optical guide member is also rotated, so that the rotational position of a variable resistance portion mounted on the hollow shaft can be indicated on the end face of the knob by the light.

4 Claims, 5 Drawing Figures

ILLUMINATED VARIABLE RESISTOR

BACKGROUND OF THE INVENTION

The present invention relates to a rotary variable resistor, and more particularly to a rotary type illuminated variable resistor.

Variable resistors of the specified type have been extensively used in audio equipment etc. It is often desired that the rotational position of a variable resistance portion in the variable resistor can be seen from outside. Nevertheless, it has been difficult to realize such construction inexpensively.

SUMMARY OF THE INVENTION

An object of the present invention is to provide a rotary type illuminated variable resistor in which the rotational position of a variable resistance portion can be seen at the end face of a knob.

In a rotary type illuminated variable resistor according to the present invention, a light source is disposed in a case, while optical guide members for conveying light from the light source are respectively disposed in a hollow shaft and a knob. When the optical guide member arranged in the knob is rotated along with the knob, the rotational position of a variable resistance portion mounted on the hollow shaft is indicated on the end face of the knob by light.

PREFERRED EMBODIMENTS OF THE INVENTION

FIGS. 1 to 4 illustrate an embodiment of the present invention. The illuminated variable resistor embodying the present invention is constructed of a knob portion A, a shaft portion B, a variable resistance portion C and a light source portion D.

Figure 1:
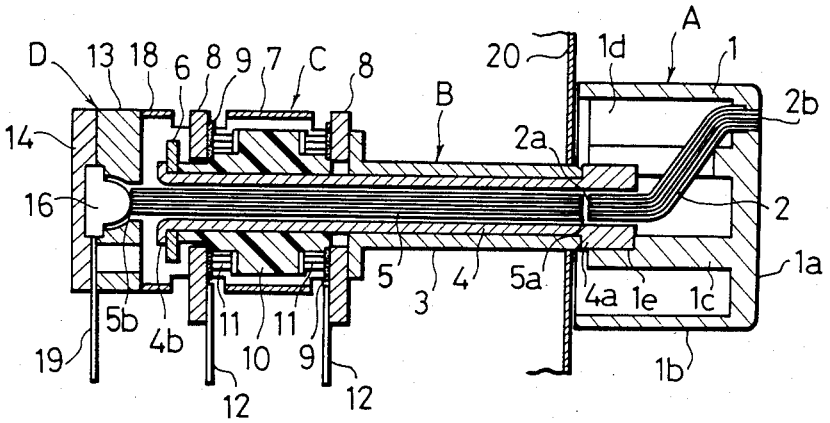
FIG. 1 is a side sectional view of an illuminated variable resistor according to the present invention.

The knob portion A is composed of a knob 1 and a second optical guide member 2. The front surface of the knob 1 is formed of an end face 1*a* and an annular jetty 1*b* extending from the end face 1*a* in the shape of a cylinder, as shown in FIGS. 1 and 3. Additionally a tubular protruberance 1*c* extends concentrically within the annular jetty 1*b*, a pair of partition walls 1*d*, 1*d* and are connected to the tubular protruberance 1*c*. A fitting hole 1*e*, as shown in FIGS. 1 and 2, is also provided.

Figure 2:
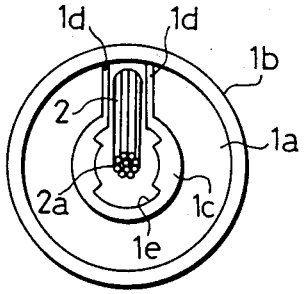
FIG. 2 is a side view of a knob portion in FIG. 1 as seen from the rear surface side thereof.
Figure 3:
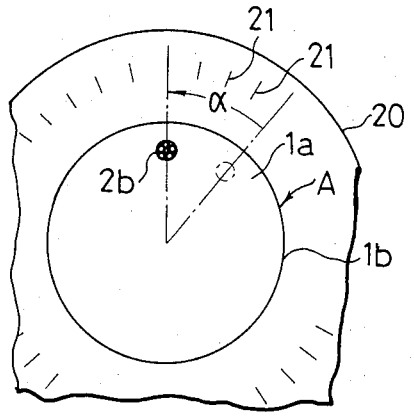
FIG. 3 is a side view of the knob portion in FIG. 1 as seen from the front surface side thereof.

As illustrated in FIGS. 1 and 2, the second optical guide member 2 is arranged within the knob 1. In order to realize the necessary display on the end face 1*a*, the second optical guide member 2 is bent in such a manner that the base end 2*a* thereof is located at the center of rotation of the knob 1, while the fore end 2*b* thereof is located at a position spaced from the center of rotation of the knob 1.

As shown in FIG. 1, the shaft portion B is composed of a bearing 3, a hollow shaft 4 rotatably journaled in the bearing 3, and a first optical guide member 5 arranged within the hollow shaft 4.

The flange 4*a* of the hollow shaft 4 is snugly fitted in the fitting hole 1*e* of the knob 1, and the rear end 4*b* thereof is rotatably mounted on a retaining ring 6, so that the hollow shaft 4 is rotated by turning the knob 1. The fore end 5*a* of the first optical guide member 5 confronts the base end 2*a* of the second optical guide member 2, while the other end 5*b* thereof confronts the light source portion D.

The variable resistance portion C is composed of a case 7, a pair of insulating substrates 8, 8, resistance films 9, 9, a slider receiver 10, sliders 11, 11 and a pair of terminals 12, 12. The rotation of the hollow shaft 4 rotates the slide receiver 10 and the sliders 11, 11, so that these sliders 11, 11 slide on the resistance films 9, 9 deposited on the pair of insulating substrates 8, 8. Thus, the resistance between the pair of terminals 12, 12 is varied.

Figure 4:
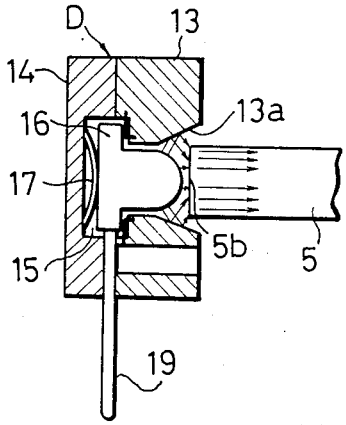
FIG. 4 is an enlarged side sectional view of a light source portion in FIG. 1.

As shown in FIGS. 1 and 4, the light source portion D is composed of a light source 16 which is arranged in a cavity 15 defined by a cover 13 and a case 14, a spring member 17, a connecting case 18, and a light source terminal 19. The light of the light source 16 is transmitted from the other end 5*b* to the fore end 5*a* of the first optical guide member 5, and further from the base end 2*a* to the fore end 2*b* of the second optical guide member 2. Thus, the slide position of the sliders 11, 11 of the variable resistance portion C is indicated on the end face 1*a* of the knob 1 so as to give visual indication of the position of the sliders. As best shown in FIG. 3, a dial plate 20 having a scale 21 is fitted on the outside of the knob.

In such structure, when the knob 1 is turned clockwise an angle $\alpha$ as shown in FIG. 3, the second optical guide member 2 fixed to the end face 1*a* of the knob 1 is also moved to a position indicated by phantom lines in FIG. 3.

On the other hand, the knob 1 and the hollow shaft 4 are integrally coupled as shown in FIG. 1, by the flange 4*a* of the hollow shaft 4 being inserted in the fitting hole 1*e* of the knob 1. Therefore, the hollow shaft 4 is also rotated the angle $\alpha$ with the turning of the knob 1. Owing to the rotation of the hollow shaft 4, the slider receiver 10 and the sliders 11, 11 are also rotated with the latter sliding on the resistance films 9, 9, thereby to vary the resistance value between the terminals 12, 12.

Meantime, as shown in FIG. 4, the light source 16 is held by the spring member 17 so as to lie at a fixed position within the cavity 15 at all times, thereby to prevent color shading or an insufficient quantity of light attributed to the positional deviation of the light source 16. In addition, the light of the light source 16 is reflected by a tapered part 13*a* formed on the open end face side of the cover 13, thereby to be efficiently converged on the other end 5*b* of the first optical guide member 5. The brightness of the light source 16 is transmitted from the other end 5*b* to the fore end 5*a* of the first optical guide member 5 in the hollow shaft 4, and further from the base end 2*a* to the fore end 2*b* of the second optical guide member 2. The rotational angle of the knob 1 as well as the resistance value of the variable resistance portion C is indicated on the knob 1 by the fore end 2*b* of the second optical guide member 2 which is fixed to the end face 1*a* of the knob 1. It can be read from the scale 21 of the dial plate 20.

In this manner, the illuminate of the light source 16 can be displayed on the end face 1*a* of the knob 1 when the knob 1 is turned. Therefore, the operator of the knob 1 can see the position of the sliders 11, 11 of the variable resistance portion C from outside at all times.

Figure 5:
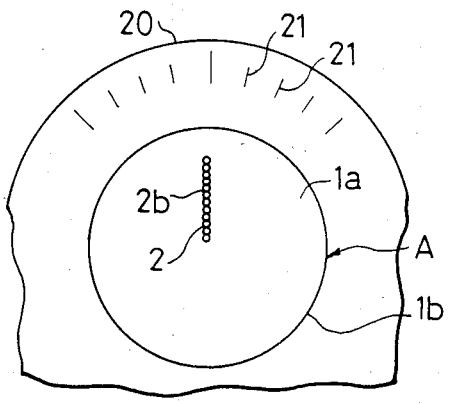
FIG. 5 is a side view of a knob portion showing another embodiment.

FIG. 5 shows a modification of the portion shown in FIG. 3. In the embodiment of FIG. 3, the fore end 2*b* of the second optical guide member 2 has the optical fiber elements thereof bundled at the end face 1*a* of the knob 1. In contrast, in the modification of FIG. 5, the fore end 2*b* of the second optical guide member 2 has the optical fiber elements thereof arrayed in a straight line, whereby the length of the display is enlarged. The other parts of the modifications are the same as in FIG. 3.

According to the present invention, the first optical guide member 5 and the second optical guide member 2 are separately disposed, and the fore end 2*b* of the second optical guide member 2 can be installed on any desired position of the end face 1*a* of the knob 1. Moreover, multifarious light guide means can be provided by changing the shape of the fore end 2*b* of the second optical guide member 2, and light guide means as required can be set at will through various combinations of the knob portion A and the shaft portion B.

While the embodiments of the present invention have referred to the one-shaft two-throw variable resistor, the present invention is not restricted thereto but is also applicable to a two-shaft multi-throw variable resistor with, e.g., a switch, and so on.

The present invention consists in an illuminated variable resistor comprising a rotatable knob, a second optical guide member which is arranged in said knob with its one end located at a center of rotation of said knob and its other end located at a position spaced from the center of rotation, a variable resistance portion, a hollow shaft whose one end is coupled to a turning part of said variable resistance portion and whose other end is coupled to said knob, a light source portion, and a first optical guide member which is arranged inside said hollow shaft and which confronts said light source portion at one end thereof and said one end of said second optical guide member at the other end thereof, whereby the rotational position of the variable resistance portion can be seen on the end face of the knob. Therefore, the variable resistance value of the variable resistor can be indicated on the end face of the knob.

What is claimed is:

1. An illuminated variable resistor comprising a rotatable knob, a second optical guide member which is arranged in said knob with its one end located at a center of rotation of said knob and its other end located at a position spaced from the center of rotation, a variable resistance portion, a hollow shaft whose one end is coupled to a turning part of said variable resistance portion and whose other end is coupled to said knob, a light source portion, and is first optical guide member which is arranged inside said hollow shaft and which confronts said light source portion at one end thereof and said one end of said second optical guide member at the other end thereof, whereby a rotational position of said variable resistance portion can be seen on an end face of said knob.

2. An illuminated variable resistor according to claim 1, wherein said light source is held by a spring member which is disposed within a cavity defined by a cover and a case.

3. An illuminated variable resistor according to claim 1, wherein said other end of said second optical guide member has optical fiber elements thereof bundled at the end face of said knob.

4. An illuminated variable resistor according to claim 1, wherein said other end of said second optical guide member has optical fiber elements thereof arrayed in a straight line.

* * * * *